US011505758B2

(12) United States Patent
Müller et al.

(10) Patent No.: US 11,505,758 B2
(45) Date of Patent: Nov. 22, 2022

(54) USE OF CALCIUM COMPLEX LUBRICATING GREASES AND CALCIUM SULFONATE COMPLEX LUBRICATING GREASES FOR THE LUBRICATION OF WIRE ROPES

(71) Applicant: Fuchs Petrolub SE, Mannheim (DE)

(72) Inventors: Roman Müller, Mannheim (DE); Stephan Müller, Heuchelheim (DE)

(73) Assignee: FUCHS PETROLUB SE, Mannheim (DE)

( * ) Notice: Subject to any disclaimer, the term of this patent is extended or adjusted under 35 U.S.C. 154(b) by 0 days.

(21) Appl. No.: 16/471,963

(22) PCT Filed: Dec. 21, 2017

(86) PCT No.: PCT/DE2017/101100

§ 371 (c)(1),
(2) Date: Jun. 20, 2019

(87) PCT Pub. No.: WO2018/113850

PCT Pub. Date: Jun. 28, 2018

(65) Prior Publication Data

US 2019/0330556 A1 Oct. 31, 2019

(30) Foreign Application Priority Data

Dec. 21, 2016 (DE) ..... 102016125289.1

(51) Int. Cl.
*C10M 169/02* (2006.01)
*C10N 40/32* (2006.01)

(52) U.S. Cl.
CPC ..... *C10M 169/02* (2013.01); *C10M 2201/02* (2013.01); *C10M 2201/043* (2013.01);
(Continued)

(58) Field of Classification Search
CPC ..... C10M 169/02; C10M 2201/02; C10M 2201/043; C10M 2201/0606; C10M 2205/16; C10M 2040/32
See application file for complete search history.

(56) References Cited

U.S. PATENT DOCUMENTS 3,125,522 A 3/1964 Reudink
4,563,870 A 1/1986 Lucht
(Continued)

FOREIGN PATENT DOCUMENTS

CN 102250670 B 11/2011
CN 102827678 A 12/2012
(Continued)

OTHER PUBLICATIONS

Bekker, Madelyn; "The World of Wax" Oil & Fats International (OFI) vol. 26, No. 1; Jan. 2010; pp. 38-42.
(Continued)

*Primary Examiner* — Cephia D Toomer
(74) *Attorney, Agent, or Firm* — D'Ambrosio & Menon, PLLC; Usha Menon

(57) ABSTRACT

The invention relates to the use of calcium complex and calcium sulfate complex lubricating grease compositions as lubricants for wire ropes. The invention further relates to a method for producing the wire ropes and to wire ropes provided with the lubricating grease composition.

24 Claims, 3 Drawing Sheets

(52) U.S. Cl.
CPC . *C10M 2201/0606* (2013.01); *C10M 2205/16* (2013.01); *C10N 2040/32* (2013.01)

(56) References Cited

U.S. PATENT DOCUMENTS

| | | | | |
|---|---|---|---|---|
| 2011/0111995 | A1* | 5/2011 | Akita | B23K 35/362 508/451 |
| 2013/0109602 | A1* | 5/2013 | Waynick | D07B 1/144 508/180 |
| 2014/0018226 | A1 | 1/2014 | Harada | |
| 2016/0115416 | A1 | 4/2016 | Waynick | |

FOREIGN PATENT DOCUMENTS

| | | | | | |
|---|---|---|---|---|---|
| CN | 102994198 | A | * | 3/2013 | |
| CN | 103897780 | A | * | 7/2014 | D07B 1/144 |
| CN | 104327906 | A | | 2/2015 | |
| CN | 103484218 | B | | 2/2016 | |
| DE | 1130103 | B | | 5/1962 | |
| DE | 69434868 | T2 | | 6/2007 | |
| EP | 0613940 | B1 | | 9/1997 | |
| EP | 2432859 | B1 | | 3/2012 | |
| SU | 336997 | A1 | | 1/1973 | |
| WO | 2015135097 | A1 | | 9/2015 | |

OTHER PUBLICATIONS

HJ Oil "Slack Wax" [online article] [retrieved on Dec. 1, 2020] Retrieved from the Internet: <URL: https://www.hjoil.com.tw/products_show.php?getId=9&getId1=24>.

* cited by examiner

USE OF CALCIUM COMPLEX LUBRICATING GREASES AND CALCIUM SULFONATE COMPLEX LUBRICATING GREASES FOR THE LUBRICATION OF WIRE ROPES

The invention relates to the use of calcium complex lubricating grease compositions containing waxes (hybrid calcium complex lubricating greases) and calcium sulfonate complex lubricating grease compositions and/or calcium sulfonate complex lubricating grease compositions containing waxes (hybrid calcium sulfonate complex lubricating greases) as lubricants for wire ropes. The invention further relates to a method for producing the wire ropes and to wire ropes provided with the lubricating grease composition.

INTRODUCTION, PRIOR ART AND TASK

The characteristic of a lubricating grease or lubricating grease composition respectively is that a liquid oil component is absorbed and held by a thickener component. The pasty condition of a lubricating grease and its property of being spreadable, workable and easily deformable together with its adhesive characteristic ensures that the lubricating grease wets the lubrication point and the lasting lubricating effect develops at the tribologically stressed surfaces.

Among the most important rheological properties of a lubricating grease are consistency and its yield point respectively, the avoidance of post-hardening and excessive oil deposition under thermal and mechanical stress as well as stable viscosity/temperature behavior. Frequently, a thixotropic (shear-thinning) and unstable shear response of the lubricating grease is advantageous. In order to create a lubricating grease with high usage value as a function of the lubrication and equipment requirements, a lot of practical experience is necessary.

Lubricating greases generally consist of a thickening agent which is distributed homogeneously in a base oil. The most diverse materials are known as base oils. Organic and inorganic compounds are used as thickening agents. A great number of lubricating grease compositions are known These also include calcium sulfonate complex lubricating greases and calcium complex lubricating greases.

The calcium sulfonate complex lubricating greases contain a base oil and a calcium sulfonate thickener which is obtained from an overbased, particularly amorphous calcium sulfonate containing calcium carbonate, where, in the course of the reaction, the calcium carbonate transitions at least partially to a calcific structure, preferably predominantly with respect to the weight fraction. Such overbased calcium sulfonate lubricating greases containing calcite are described in detail, for example, in EP 0613940 B1.

Calcium complex lubricating greases contain a base oil and a thickener which is formed from calcium hydroxide, fatty acid and a complexing agent.

Wire ropes, sometimes also called steel ropes, constitute essential mechanical components for the transfer of tensile forces, particularly in materials handling, in the fisheries industry, mining and construction.

Wire ropes can perform static tasks, in particular in the form of guy ropes or are used to transfer force in dynamic applications, for example in cranes, elevators, cableways or ski lifts. Particularly for dynamic applications, wire ropes are subject to constantly changing loads and wear after a certain period of use, thus needing to be replaced periodically. Wearing of wire ropes is attributable to individual elements rubbing against one another among other things.

Wire ropes particularly affected by frictional wear are those used for dynamic applications, because these are subject to constant flexure during turns and/or rolling on or off.

Further optimization of the service life of wire ropes with new rope twisting techniques appears to be possible only to a limited extent as is the case with improving the quality of steel used for the wires. The selection or creation respectively of new lubricants and the improvement of service life of the tractive elements associated with that has been given only low priority for attention in recent decades. The lubricant is given the task of mitigating frictional forces between the individual elements and/or strands of a tractive element as well as preventing corrosion and friction oxidation.

Currently, along with bitumen-based lubricants, there is a growth of thixotropized lubricants based on solvates, less frequently however soap greases, and predominantly lithium soap greases in this case. An example of a wire rope lubricant containing paraffin waxes and alkali naphthalene sulfonate for corrosion protection is disclosed in DE1130103 B (=U.S. Pat. No. 3,125,522 A).

In US 2014/0182261 A2 there is a great number of very different lubricants proposed for wire ropes, among them calcium complex lubricants, but no hybrid calcium complex lubricants, calcium sulfonate complex lubricants or hybrid calcium sulfonate complex lubricants. The test method of the parallel EP 2432859 makes it apparent that this protection of property is essentially focused on inorganic solids which are softer than the metal rope and are used as a lubricant.

The task of the lubricant to be used according to the invention is to provide the following properties profile as far as possible: excellent viscosity/temperature behavior, good deliverability, low breaking point by the Fraass method, excellent protection against corrosion even with absorbed water, good compatibility with elastomers, a high dripping point, excellent wear protection behavior, good behavior under extreme pressure, low oil deposition, good oxidation stability, good adherence, good capacity for pH buffering, little loss of consistency due to water absorption and excellent shear stability (compared to thixotropic lubricants). The lubricant should also not contain bitumen, in embodiments with a low concentration of aromatically bound hydrocarbons as well, or be without these.

SUMMARY OF THE INVENTION

The task is solved by the subject matter of the independent claims. Preferred embodiments are the subject matter of the dependent claims or are described below. The invention relates to wire ropes having (i) a calcium sulfonate complex lubricating grease composition containing calcium carbonate in a calcitic structure (calcium sulfonate complex) and possibly a wax with a congealing point above 70° C. (hybrid calcium sulfonate complex) or (ii) a calcium complex lubricating grease composition containing furthermore at least one wax with a congealing point above 70° C. (hybrid calcium complex), or (iii) a mixture of (i) and (ii), and a manufacturing method for the wire ropes containing the lubricating greases above and the use of the lubricating grease composition for wire ropes. The wire ropes are preferably used for elevators, cableways, or ski lifts.

The inventive lubricating grease composition used in the wire ropes has at least the following components:

For lubricating grease, Type I: calcium sulfonate complex lubricating grease or hybrid calcium sulfonate complex lubricating grease.

The calcium sulfonate complex lubricant contains:

(A) a base oil, for example at 5-80 weight percent, in particular at 20-55 weight percent;

(B) at least one overbased calcium salt of an organic sulfonic acid, hereinafter referred to as calcium sulfonate for the sake of brevity, present, for example, as 10 to 80 weight percent, with the calcium carbonate being at least partially, perhaps completely in a calcific structure;

(C) possibly a further sulfonic acid, preferably a C12 alkyl sulfonic acid, in each case in particular for the gelation process or activation;

(D) possibly one or more activators. These are, for example:

i) 1-20 weight percent water with other alcohols such as C1 to C4 alcohols;

ii) 1-20 weight percent C1 to C4 alcohols, alkoxy alkanols and/or polyalcohols such as glycols;

iii) 1-20 weight percent water with hydroxycarboxylic acids;

iv) 1-20 weight percent mixtures comprised of i) and ii) or ii) and iii) or i), ii) and iii), where the activators are present in the lubricating grease composition during production and can possibly be driven out at least partially by heat treatment and (E) possibly a wax with a congealing point above 70° C. (hybrid calcium sulfonate complex lubricating grease).

For lubricating grease, Type II: Hybrid calcium complex lubricating grease

The inventive Ca complex lubricating grease used has at least the following components:

(a) a base oil such as 40-90 weight percent, in particular 60-80 weight percent;

(b) at least one calcium soap of at least one fatty acid including a hydroxy fatty acid;

(c) at least one complexing agent; and (d) a wax with a congealing point above 70° C.

Both types of lubricating grease can contain the following optional components:

lubricating grease additives;

other thickeners, such as other metal soaps of C10 to C36 carboxylic acids as well as their hydroxycarboxylic acids;

salts of phosphoric acid, acetic acid, boric acid and/or a dicarboxylic acid;

and/or polyurea thickener.

The invention also relates to wire ropes provided with the lubricating grease composition and the production of wire ropes with the introduction of the lubricating grease composition.

Waxes are materials which are solid at 20° C. and above and can be kneaded; they are transparent to opaque, but are not glasslike, and above 40° C. they melt without decomposition and have a relatively low viscosity above the melting point.

The lubricating grease composition is also designated below as a rope lubricant.

DETAILED DESCRIPTION OF THE INVENTION

Figure 1:
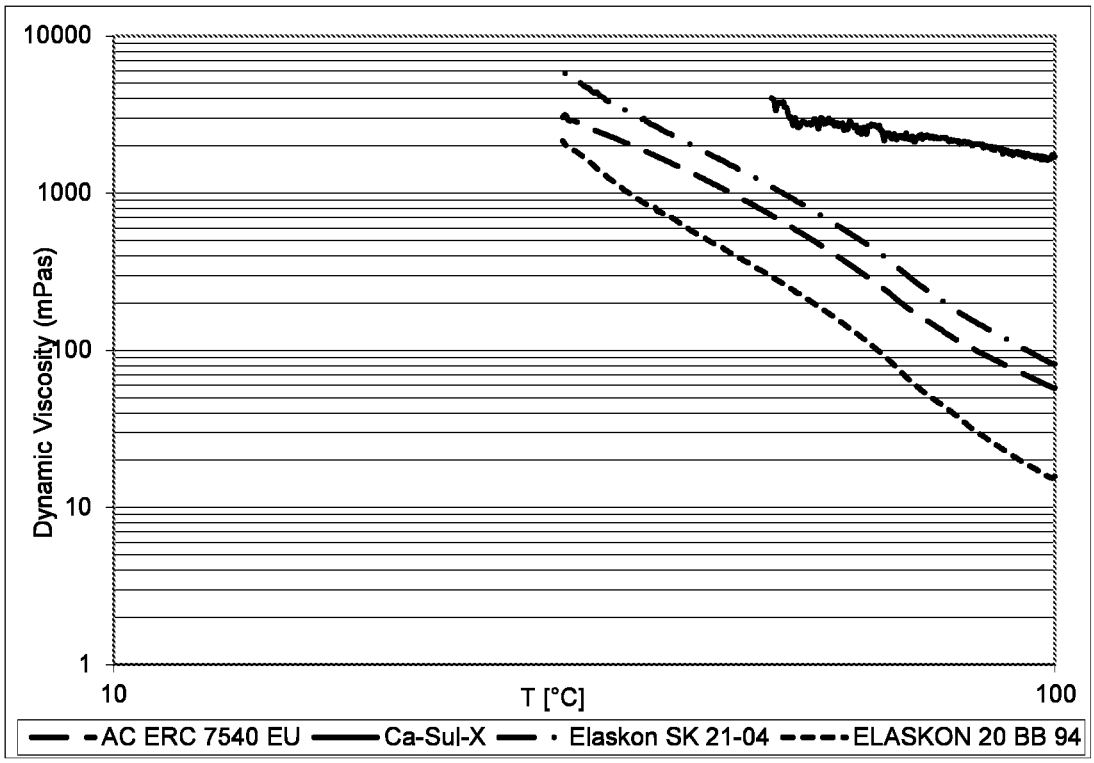
FIG. 1: Determination of the shear viscosity using a rotational viscometer according to DIN 51810, comparison of the dynamic viscosity/temperature curves.

The wire ropes used according to the invention can have very diverse embodiments. They always consist of multiple wires which, according to one preferred embodiment, are twisted into strands and/or twisted in such a way that multiple strands form a wire rope.

As an example, the wire rope can have a fiber core made of steel or plastic around which the strands are twisted with six wires in each case, with a further wire layer emplaced about this wire layer and having 12 strands comprised in each case of six wires. The individual elements can be provided with a common sheathing, for example made from a plastic. Along with wires and strands, inlays and fiber inserts can also be used.

Wire ropes can, for example, have both a core wire or a core strand as well as an insert (also referred to as a "soul"). Fiber inserts are fibers or solid polymers arranged such that they separate adjacent strands or wires in the same layers or superposed ones, or fill the interstitial spaces of the rope. Distinctions are made for essentially three types of inlay materials: fiber inlays made from natural fibers or synthetic fibers and steel inlays. Steel inlays can be made from one or more wire strands or as independently twisted wire rope. Polymer inlays can include a solid polymer in cylindrical form with and without grooves. Wire ropes in the sense of the present invention thus do not necessarily consist exclusively of steel, but instead can also include synthetic or natural materials.

Lubricating grease, Type I: calcium sulfonate complex lubricating grease and hybrid calcium sulfonate complex lubricating grease.

To produce the calcium sulfonate complex lubricating greases, overbased calcium sulfonate is placed in a base oil. Calcium carbonate can be added, but need not be. After good mixing, edition of the activator(s) takes place, in particular at 40 to 100° C. The addition of sulfonic acid leads to gelation after some time delay, depending on the temperature. This can also take place with slight excess pressure, which increases the speed of the reaction. After sufficient gelation, heating above the boiling point of the activator(s) occurs to remove the activator mixture. If desired, the consistency of the lubricating grease can be thickened further by also adding additional thickeners cited above (see above, under "Optional components").

To optimize the soap structure, heating now takes place to approximately 170-190° C., and the temperature is maintained for 30 to 60 minutes. After cooling to approximately 60 to 100° C., additives can be included to reduce wear and to improve resistance to oxidation and corrosion protection, etc.

The base oil (A) is used predominantly as a dispersion medium, i.e. as a liquid carrier in which the solid particles are dispersed. Usually the base oil consists of organic liquids which are essentially chemically inactive during the production or use as intended. The base oil preferably has a kinematic viscosity of 20 to 1000 $mm^2/s$, preferably 100 to 500 $mm^2/s$ (at 40° C. in each case).

The base oil is generally a non-volatile organic liquid at room temperature, which can also contain volatile components which are usually separated after the synthesis or refining. Volatile components are defined in the present case as those which boil at up to about 100° C. at normal pressure, such as water or C1 to C4 alcohols. The base oil preferably has a flashpoint greater than 180° C., in particular above 200° C.

Examples of corresponding organic liquids are alkanes and cycloalkanes, aromatics and cycloaromatics, which can also be correspondingly substituted with alkyl and/or alkenyl groups; ethers such as dialkyl ethers; alkyl aryl ethers; cycloalkyl ethers; alkyl cycloalkyl ethers; alkanols, alkylene glycols, polyalkylene glycols and esters of these glycols; alkyl ethers of alkylene glycols and polyalkylene glycols; silicate esters, glycerides, epoxidized glycerides, aliphatic and aromatic esters; and/or paraffin sludge (unrefined petroleum fractions based on paraffin).

Low molecular weight liquid polymerizates, generally referred to as oligomers, are also suited as base oils. This includes dimers, trimers, tetramers, pentamers and suchlike. Special examples for this large group of materials are poly-alphaolefins as oligomers with an average of 2 to 6 or more units of C8 to C13 alpha-olefins or, defined independently thereof by a viscosity of 2 to 100 $mm^2/s$ (at 100° C.). Another important group are polyisobutylenes with 200 to 4000 g/mole (number average).

From the perspective of easy accessibility, cost and properties, alkyl, cycloalkyl, aryl and alkyl aryl hydrocarbons represent the preferred class of base oils. Liquid petroleum fractions represent a further preferred class of base oils. These preferred classes include benzenes and alkylated benzene, naphthalenes and alkyl naphthalenes, cycloalkanes and alkylated cycloalkanes, cycloalkenes and alkylated cycloalkanes which occur in the petroleum fractions based on naphthalene as well as alkanes which occur in the petroleum fractions based on paraffin.

Particularly preferred as dispersed systems are those which have at least a certain fraction of mineral oil as a component of the dispersed medium.

The term "calcium sulfonate" (B), as used here in conjunction with the calcium sulfonate complex lubricating grease, generally refers to those sulfonates in which the sulfonic acid (without the metal counterion) as a molecular weight in the range of 200 to 1400 g/mol, in particular 300 to 700 g/mol. The calcium sulfonates are generally formed in situ from a mixture of calcium oxide and/or calcium hydroxide, particularly preferably calcium hydroxide, and the sulfonic acid, preferably in solution in a volatile organic solvent like the activators above, and a mineral oil.

The calcium sulfonate is referred to as overbased, because it contains in excess of calcium carbonate and/or calcium hydroxide. The calcium hydroxide can also be provided as calcium oxide. The actual stoichiometric excess of metal can vary considerably, for example from 0.1 to about 30 or more molar equivalents, in particular more than 0.5, so that a total base number (TBN) is set.

The overbased calcium sulfonate preferably has a TBN of 40 to 600, in particular 200 to 600, measured according to ISO 3771.

The calcium carbonate is present as colloidal particles in the dispersion medium. Preferably the maximum particle size is under 5000 Å. Particularly preferably, average particle sizes are less than 400 Å, for example in the range of 20 to 300 Å.

The further sulfonic acids (C) can be soluble in oil as well as possibly soluble in water at the same time too. Preferred sulfonic acids have the following structure: the sulfonate group is bonded to a cyclic or aromatic group, with the cyclic or aromatic group furthermore having one or more linear or branched C1 to C30 hydrocarbyl groups, preferably one or two C8 to C18 hydrocarbyl groups. Examples are alkyl benzenesulfonic acids such as the dobanic acid (dodecyl benzenesulfonic acid).

These sulfonic acids or sulfonates can be synthetic or natural sulfonates, the so-called "mahogany sulfonates". The term "synthetic sulfonates" refers to those sulfonates which are produced synthetically from the sulfonation of materials used. The synthetic sulfonates include alkyl sulfonates and alkyl or dialkyl aryl sulfonates. The aryl group can be derived from benzene, toluene, phenylbenzene, diphenylbenzene, diphenylmethane, ethylbenzene, xylene isomers or naphthalene. The cyclic group can be cyclohexane or hexahydronaphthalene, for example.

An example of dialkyl aryl sulfonates are those with alkyl groups having 8 to 18 carbon atoms in each case. They are primarily differentiated from the preceding materials used for sulfonation in that they are straight-chained and contain a large amount of disubstituted material.

Additional sulfonates which can be used include, for example, lignin sulfonates, mono- and poly-wax-substituted naphthalene sulfonates, dinonyl naphthalene sulfonates, naphthalene disulfide sulfonates, dicetyl thianthrene sulfonates, dilauryl beta-naphthol sulfonates, unsaturated paraffin wax sulfonates, hydroxy substituted paraffin wax sulfonates, cycloaliphatic sulfonates such as lauryl cyclohexyl sulfonates and mono- or poly-wax-substituted cyclohexyl sulfonates.

The use of a mixture of water and one or more alcohols (including glycols), short-chained (C1 to C4) carboxylic acids or corresponding hydroxycarboxylic acids are particularly effective for the calcium sulfonate complex lubricating greases for converting the overbased materials from predominantly amorphous to predominantly calcitic structures. Such combinations often reduce the time required to carry out the process and are thus referred to as activators (E).

Suitable alcohols are aliphatic, cycloaliphatic and aryl aliphatic mono- or polyhydroxy alcohols. Alcohols with fewer than 12 carbon atoms are particularly suitable, for example. For reasons of economy and to ensure practical execution of the method, lower-chain alkanols, such as those with fewer than 8 carbon atoms, are preferred. Examples of these are alkanols such as methanol, ethanol, isopropanol, n-propanol, isobutanol, t-butanol, n-pentanol and suchlike; cycloalkyl alcohols such as cyclopentanol, cyclohexanol, 4-methylcyclohexanol, 2-cyclohexylethanol and cyclopentylmethanol; phenylaliphatic alkanols such as benzyl alcohol, 2-phenylethanol and cinnamyl alcohol; alkylene glycols with up to six carbon atoms and their mono-, di- or tri-C1 to C6 alkyl ethers such as ethylene glycol monomethyl ether, diethylene glycol, ethylene glycol, trimethylene glycol, hexamethylene glycol, triethylene glycol, 1,4-butanediol, 1,4-cyclohexanediol, glycerin, butyl glycol, butyl diglycol, butyl triglycol and pentaerythritol.

A particularly effective combination is comprised of a mixture of one or more activators and water in a weight ratio of activator(s) to water of about 1:0.05 up to 1:24, preferably from 1:2 up to 1:6. Preferably, there is at least one lower-chain alkanol or glycol present in the alcohol fraction of these water/alkanol mixtures.

It is particularly advantageous to use lower quantities of a volatile activator such as water or an aliphatic C1 to C4 alcohol which is water soluble or easily miscible with water or dispersible in water, preferably isopropanol, and/or an alkoxy alkanol or glycols (particularly mono-, di- or triglycols) which are water-soluble or easily miscible with water or easily dispersible in water, in each case with 2 to 20 carbon atoms, including their mono-C1 to C4-alkyl ethers, and mixtures of one or more of these activators.

Lubricating grease, Type II: Hybrid calcium complex lubricating grease

Usually, to produce the hybrid calcium complex lubricating greases, the procedure involves placing the base oil, fatty acid (including hydroxy fatty acids) and/or triglyceride in a container and heating to approximately 80° C. until all components are melted.

Then $Ca(OH)_2$ and possibly water are added. Complexing agents are also added. The temperature is increased to 100° C. to start the reaction. After the reaction water is driven out, the reaction mixture is heated further, for example to a maximum of 270° C. After cooling to approximately 60 to 100° C., the lubricant additives are included to reduce wear and to improve resistance to oxidation and corrosion protection, etc.

The base oil (a) can be specified as described above for the base oil (A).

The Ca soap is a calcium salt of one or more saturated or unsaturated monocarboxylic acids with 10 to 36 carbon atoms, possibly substituted, in particular with 12 to 22 carbon atoms, particularly preferably corresponding hydroxycarboxylic acids. Suitable carboxylic acids are, for example, lauric acid, myristic acid, palmitic acid, oleic acid, stearic acid or behenic acid and preferably 12-hydroxystearic acid. Instead of free acid groups, corresponding lower-chain alcohol esters can also be used with saponification, for example corresponding triglycerides and the methyl-, ethyl-, propyl-, isopropyl- or sec-butyl esters of the acid/hydroxy acid in order to achieve better dispersion.

Examples of complexing agents (c) are C1- to C6-carboxylic acids, C6- to C12 di- and/or tricarboxylic acids, benzoic acid, boric acids and their salts, phosphoric acids and their salts, in particular calcium salts but also lithium, sodium or potassium salts. Mixtures of two or more of these components are also suitable. Particularly suitable complexing agents are detailed below.

The lower-chain aliphatic carboxylic acids are C1- to C6-carboxylic acids. Examples of this class of acids are formic acid, acetic acid, propionic acid, butyric acid, valeric acid, isovaleric acid, isobutyric acid, caprylic acid, chloroacetic acid, dichloroacetic acid, trichloroacetic acid and suchlike. Formic acid, acetic acid and propionic acid are preferred, with acetic acid and propionic acid being especially suitable. The anhydrides of these acids are also suitable, so the expression acid includes both the acid as such as well as its anhydride in accordance with the invention.

Hydroxybenzoic acids such as p-hydroxybenzoic acid, salicylic acids, 2-hydroxy-4-hexylbenzoic acid, m-hydroxybenzoic acid, 2,5-dihydroxybenzoic acid (gentisic acid), 2,6-dihydroxybenzoic acid (gamma-resorcylic acid) or 4-hydroxy-4-methoxybenzoic acid are also suitable. In particular, adipic acid ($C_6H_{10}O_4$), sebacic acid ($C_{10}H_{18}O_4$), azelaic acid ($C_9H_{16}O_4$) and/or 3-t-butyl adipic acid ($C_{10}H_{18}O_4$) are particularly suited as dicarboxylic acids.

Boric acid or boronic acids are also suitable complexing agents. These include boronic acids such as alkyl-$B(OH)_2$; or aryl-$B(OH)_2$, boric acid (i.e. $H_3BO_3$), tetraboric acid, metaboric acid and esters of these boric or boronic acids respectively. Examples of borates which can be used include metaborates, diborates, tetraborates or orthoborates, such as calcium orthoborate or lithium tetraborate.

Phosphoric acids and their salts are also suitable complexing agents. This includes various alkyl and aryl phosphinic acids, and corresponding phosphinous phosphonic and phosphonous acids. Phosphoric acids produced by converting lower-chain alkanols or unsaturated hydrocarbons such as polyisobutenes with phosphorus oxides and phosphorus sulfides such as $P_2O_5$ and $P_2S_5$ are particularly suitable. Phosphates to be considered are alkali (preferably lithium) as well as alkaline earth (preferably calcium) dihydrogen phosphate, hydrogen phosphate, or pyrophosphate.

Thus, complexing agents in terms of the present invention are, for example:

- the calcium salt of a saturated or unsaturated monocarboxylic acid or also hydroxycarboxylic acids with 2 to 8, in particular 2 to 4 carbon atoms or a dicarboxylic acid with 2 to 16, in particular 2 to 12 carbon atoms, in each case possibly substituted, and/or
- the calcium salt or lithium salt of the boric acid and/or the sodium or calcium salt of the phosphoric acid and/or
- acetic acid or their salts such as calcium acetate.

The wax can be added during or after production of the soap(s).

Optionally, bentonites such as montmorillonite (its sodium ions possibly replaced by ammonium ions in whole or in part), aluminosilicates, clays, silica (such as Aerosil) or also di- and polyureas can also be used as co-thickeners.

The bentonites, aluminosilicates, clays, silica and/or oil-soluble polymers can be added to the production of the base grease or in particular be formulated later as an additive in the second step. The di- and polyureas can be used as an additive.

The further components named below can be added to both the calcium sulfonate complex lubricating grease and the hybrid calcium complex lubricating grease.

C10-C36-carboxylic acids and their hydroxycarboxylic acids can be used as additional thickeners, as can their esters in each case (such as those with methanol or glycerin as mono-, di- or triglyceride).

According to a further embodiment, the inventive rope lubricants contain waxes. These are presently referred to as hybrid lubricants. The waxes are in particular hydrocarbon waxes such as paraffin waxes, isoparaffin waxes (microwaxes), polyolefin waxes such as PE waxes or PP wax, FT waxes, GTL waxes, etc., candelilla wax, ozocerite, or polyamide waxes. Further group of waxes are esterbased waxes such as carnauba wax, candelilla wax, montan waxes or alcoholbased waxes such as shellac waxes.

The group of natural waxes includes ozocerite and montan wax (fossil waxes), candelilla wax and carnauba wax (plant waxes) or shellac waxes (animal wax). The group of synthetic waxes includes polyamide wax (polymer wax) or GTL or FT wax respectively.

The waxes have a congealing point above 70° C., in particular above 110° C. or alternatively above 140° C. (measured, for example, in accordance with DIN ISO 2207).

The waxes are contained at 10 to 50 weight percent, in particular 20 to 35 weight percent in the lubricating grease composition.

Two or more waxes can be used, with the one wax fraction having the congealing points indicated above and the further wax fraction having a congealing point that is at least 10° C., preferably at least 20° C. lower.

Preferably, the dripping point of the lubricating grease is above 325° C. according to DIN ISO 2176.

The inventive compositions possibly contain further lubricant additives as admixtures. Usual additives in terms of the invention are antioxidants, antiwear agents, anticorrosion agents, detergents, dyes, lubricity enhancers, viscosity additives, friction reducers and high-pressure additives and solid lubricants.

Examples of lubricant additives to name include:

- antioxidants such as amine compounds (for example alkyl amines or 1-phenylaminonaphthaline), aromatic amines such as phenylnaphthyl amine or diphenylamine, phenol compounds (such as 2,6-di-t-butyl-4-methylphenol), sulfur antioxidants;
- high pressure additives such as organic chloro, sulfur and/or phosphorus compounds or organic bismuth compounds;
- adhesive-promoting agents such as C2 to C6 polyols, polyglycols, fatty acids, fatty acid esters or animal- or plant-based oils;
- anticorrosion agents such as petroleum sulfonate, dinonylnaphthalene sulfonate, sorbitan esters, sarcosine, succinimide, fatty acid derivatives or imidazoline,
- metal deactivators such as Benzotriazole and its derivatives, mercaptothiadiazole or sodium nitrite;
- viscosity enhancers such as polymethylacrylate, polyisobutylene, poly-alphaolefins such as oligo-dec-1-ene, oligocopolymers (ethylene and propylene copolymerizates) and polystyrenes.
- wear protection additives and friction reducers such as Mo compounds like organomolybdenum complexes (OMCs), molybdenum dialkyl dithiophosphates, molybdenum dialkyl dithiocarbamates, or molybdenum sulfide dialkyl dithiocarbamates, in particular molybdenum di-n-butyl dithiocarbamate and molybdenum disulfide dialkyldithiocarbamate ($Mo_2O_mS_n$(dialkyl carbamate)$_2$ with m=0 to 3 and n=4 to 1), metal (e.g. zinc) or ammonium dithiocarbamate;
- friction reducers such as functional polymers like coleyl amides, organic compounds based on polyethers and amides such as alkyl (polyethylene glycol) (tetradecylene glycol) ether, alkyl and/or aryl phosphoric acid esters, phosphonic acid esters and thiophosphoric acid esters;
- additives for light and UV protection.

Moreover, the inventive lubricating grease compositions contain typical lubricants additives to protect against corrosion and oxidation as well as metal influences which act as chelating compounds, radical traps, UV protection, reaction layer formers and suchlike.

Solid lubricants which can be used include, for example, polymer powders such as polyamides, polyimides or PTFE, graphite, metal oxides, boron nitride, metal sulfides such as molybdenum disulfide, tungsten disulfide or mixed sulfides based on tungsten, molybdenum, bismuth and zinc, salts of alkali and alkaline earth metals such as calcium carbonate, sodium and calcium phosphates. Solid lubricants can be categorized in the following groups: Compounds with a layer lattice structure, such as molybdenum disulfide and tungsten disulfide, graphite, hexagonal boron nitride and some metal halides, oxidic and hydroxidic compounds of the transition and alkaline earth metals or their carbonates or phosphates respectively; soft metals and/or plastics. The desired advantageous lubrication properties can also be established by the use of lignin sulfonates without having to use solid lubricants. In many cases, these can be omitted entirely or at least significantly reduced.

The rope lubricants based on hybrid calcium complex soaps contains at least the following components:

| | Ranges [weight %] |
|---|---|
| Base oil | 40 to 90, preferably 60 to 80 |
| Ca complex soap (Ca soap plus complexing agent) | 5 to 55, preferably 10 to 50 or 5 to 30, preferably 10 to 20 |
| Additives (optional) | 0 to 20, preferably 0.5 to 10 |
| Waxes | >0 to 50, preferably 10 to 35, in particular 20 to 35 |

The numeric values add up to 100 weight percent in each case.

The rope lubricants based on calcium sulfonate complex soaps or hybrid calcium sulfonate complex soaps contains at least the following components:

| | Ranges [weight %] |
|---|---|
| Base oil | 5 to 60, preferably 20 to 40 |
| Ca sulfonate complex soap | 10 to 80, preferably 20 to 70 or 10 to 33, preferably 20 to 30 (for example, if further thickeners are used) |
| Additives (optional) | 0 to 20, preferably 0.5 to 10 |
| Waxes (optional) | 0 to 50, preferably 10 to 35 or, if present, >0 to 50, preferably 10 to 35, most preferably 20 to 35 |
| Activators (driven out or converted in the course of the reaction generally) | At least greater than 1, preferably greater than 2, in particular 1 to 20 or 2 to 10. |
| Other thickeners (optional) for example, simple or complex soaps of Ca, Li or Al. | 0 to 40, preferably 2 to 20 |

The numeric values add up to 100 weight percent in each case.

A particular aspect of the inventive rope lubricants used is the light appearance, because it is not necessary to use bitumen or black, solid lubricants to achieve the required properties.

Typical methods for applying rope lubricants to the wires are spraying (by aerosol, airless or even electrostatic means), coating, injecting, immersion coating, flow coating, roller application, powder coating and suchlike. The consistency of the composition can be adapted to the respective application method.

To manufacture the wire rope from multiple wires, preferably, prior to combining the wires and/or strands, the inventively used rope lubricant is applied to the elements. The rope lubricants can also be used for relubrication.

Preferably, the individual tension-resistant elements are moved past a stationary spraying apparatus. In this way, even very long tension-resistant individual elements can have a lubricating grease composition applied in a simple manner with limited space available. Here the tension-resistant elements, such as metal wires, can be unwound continuously from a roll with a spooler, past the stationary spraying apparatus and then shaped into a flexible and redirectable tension element, which in turn is wound onto a receiving roll.

The inventive rope lubricants can, possibly after thinning or in thinned form respectively or by heating, also be used for saturation of the fiber cores of the ropes, for example rope fiber cores made of sisal rope, and placement in the inventive rope lubricant. The wire fiber core is then used for re-lubrication as well from an interior reservoir.

Experimental Part

A. Rope Lubricants Used—Commercial Products and Inventive Products

A.1 Rope Lubricant Based on a Calcium Sulfonate Complex Soap (Ca-Sul-X)

| Materials used: | Weight % |
|---|---|
| Overbased Ca sulfonate* | 54 |
| Base oil | 19.7 |
| Tap water | 5 |
| Butyl glycol | 1.3 |
| Dobanic acid | 5.3 |
| $Ca(OH)_2$ | 2.8 |
| 12-hydroxy stearic acid | 3.65 |
| Acetic acid (60 weight %) | 0.6 |
| Phosphoric acid (75 weight %) | 2.75 |
| $CaCO_3$ | 4.9 |

*Ca sulfonate with TBN 400, commercial product: Calcinate ® OR from Chemtura

The base oil was premixed with the Ca sulfonate and heated to 80° C. Then the addition of the tap water and butyl glycol took place with constant stirring; after thorough mixing, the dobanic acid was added with stirring (maintaining temperature at 80° C.). Gelation occurred with a time delay.

After approximately one hour, the temperature was increased to 105° C., and calcium hydroxide was added, followed by 12-hydroxystearic acid. After a waiting period of 15 minutes, the acetic acid was added in portions. The same procedure was followed with the phosphoric acid. Then heating took place to 175-180° C. for 30 minutes, followed by cooling. The $CaCO_3$ was added at approximately 60° C. The lubricating grease was homogenized with a three roll mill.

A.2 Rope Lubricants Based on a Hybrid Calcium Sulfonate Complex and Wax Soap (Hybrid Ca-Sul-X)

25 weight percent Brightstock BS 150 was added to 50 weight percent Ca-Sul-X and heated to 80° C. in a lubricating grease vessel with stirring. Then a paraffin wax (25 weight percent) with the congealing point of 70° C. was added in portions. After homogeneous mixing, it was cool to approximately 60° C. Then homogenization took place using a three roll mill.

A.3 Hybrid Ca—X Rope Lubricant Based on a Calcium Complex Soap

| Example of a Ca complex soap | |
|---|---|
| Materials Used | Weight % |
| Base oil | 74.08 |
| $Ca(OH)_2$ | 2.82 |
| Trisodium phosphate | 0.42 |
| Sodium tetraborate decahydrate | 0.42 |
| Calcium acetate | 7.42 |
| Mixed fatty acids* | 7.42 |
| Suet | 7.42 |

*commercial product: PRIFAC 5910 from CRODA

** commercial product: Suet, technical grade from SONAC

The base oil was premixed with the mixed fatty acids and suet, then heated to 80° C. Then an aqueous slurry of $Ca(OH)_2$ was added. Then further, an aqueous solution of trisodium phosphate, sodium tetraborate decahydrate and calcium acetate was added. Now the temperature was increased stepwise to 250° C. with a dwell time of about 30 minutes. After cooling to about 60° C., the lubricating grease (Ca—X) was homogenized with a three roll mill.

25 weight percent Brightstock BS 150 was added to 45 weight percent Ca—X and heated to 80° C. in a lubricating grease vessel with stirring. Then a paraffin wax with a congealing point of 70° C. was added in portions. After homogeneous mixing, it was cooled to approx. 60° C., and 5 weight percent of a corrosion protection additive (neutral calcium sulfonate) was added. Then homogenization took place using a three roll mill.

The following rope lubricant based on a calcium sulfonate complex soap (consistency class NLGI 000) can be used to saturate sisal fiber cores.

| | |
|---|---|
| Overbased Ca sulfonate | 27% |
| Base oil | 59.0% |
| Tap water | 2.5% |
| Butyl glycol | 0.65% |
| Dobanic acid | 2.65% |
| Optional | |
| $Ca(OH)_2$ | 1.4% |
| 12-hydroxy stearic acid | 1.8% |
| Acetic acid | 0.3% |
| Phosphoric acid | 1.85% |
| $CaCO_3$ | 2.45% |

A.4 Commercial Products Used

| | |
|---|---|
| ANTICORIT ERC 7540 EU | from FUCHS in Mannheim, Germany (ANTICORIT ERC 7540 EU is a product from base oil wax with additives for improving corrosion protection and reducing wear) |
| ELASKON SK 21-04 | from Elaskon in Dresden, Germany (wax-based rope lubricant) |
| ELASKON 20 BB 94 | from Elaskon in Dresden, Germany (wax-based rope lubricant) |
| NYROSTEN T55 | from Nyrosten in Geldern, Germany (wax-based rope lubricant) |
| RENOLIT LC-WP 2 | from FUCHS in Mannheim, Germany - Li/Ca 12-hydroxystearate with a corrosion protection additive |
| RENOLIT CA-FG 50 | from FUCHS in Mannheim, Germany - Ca 12-hydroxystearate without corrosion protection additive |
| Elaskon SK-U | from Elaskon in Dresden, Germany (wax-based rope lubricant) |
| Elaskon SK-CE | from Elaskon in Dresden, Germany (wax-based rope lubricant) |
| Berucoat AK 376 | from Beechem in Hagen, Germany - PTFE-based aqueous paste with organic binder |
| Macromelt | from Henkel in Düsseldorf, Germany |
| Bio Grease MP 2 | from INTERFLON in Roosendaal, Netherlands - PTFE-functionalized lithium soap grease with a wear protection additive containing phosphorous. |
| OKS 450 | from OKS Spezialschmierstoffe, Maisach-Gernlinden in Germany, synthetic oil with ZnDTP with Mo wear protection additive and calcium sulfonate as a corrosion protection additive |

B.1 Determination of the Shear Viscosity of Lubricating Greases Using a Rotational Viscometer According to DIN 51810

A sufficient quantity of lubricating grease was applied without bubbles to a plate using a spatula. After combining the measurement system with the cone and plate, the excess lubricating grease was wiped off. The shear viscosity of the lubricating grease was determined by measuring the torque as a function of the rotational speed at constant temperature. The shear stress and the shear speed are calculated from the torque and speed of rotation. A cone/plate viscometer from the firm Anton Paar was used and operated with the following parameters: temperature range 30-100° C., heating rate 1° C./min, 50 mm diameter cone, angle of the cone 1° and shear rate 500 1/s. ANTICORIT ERC 7540 EU, ELASKON SK 21-04 and ELASKON 20 BB 94 were investigated as well as the inventive product Ca-Sul-X.

Significantly improved viscosity/temperature behavior was found compared to rope lubricants based on oil and wax. The inventive greases show viscosity/temperature curves with the desired flat plot, cf. FIG. 1.

Figure 2:
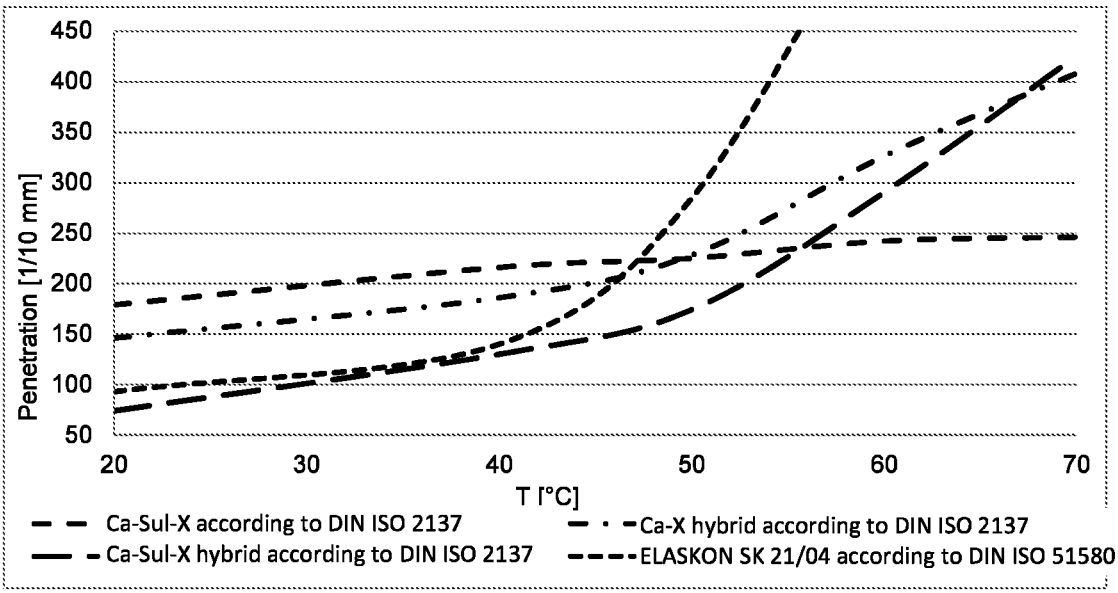
FIG. 2: Shear stability temperature dependency: comparison of the cone penetration/temperature curves according to DIN ISO 2137.
Figure 3:
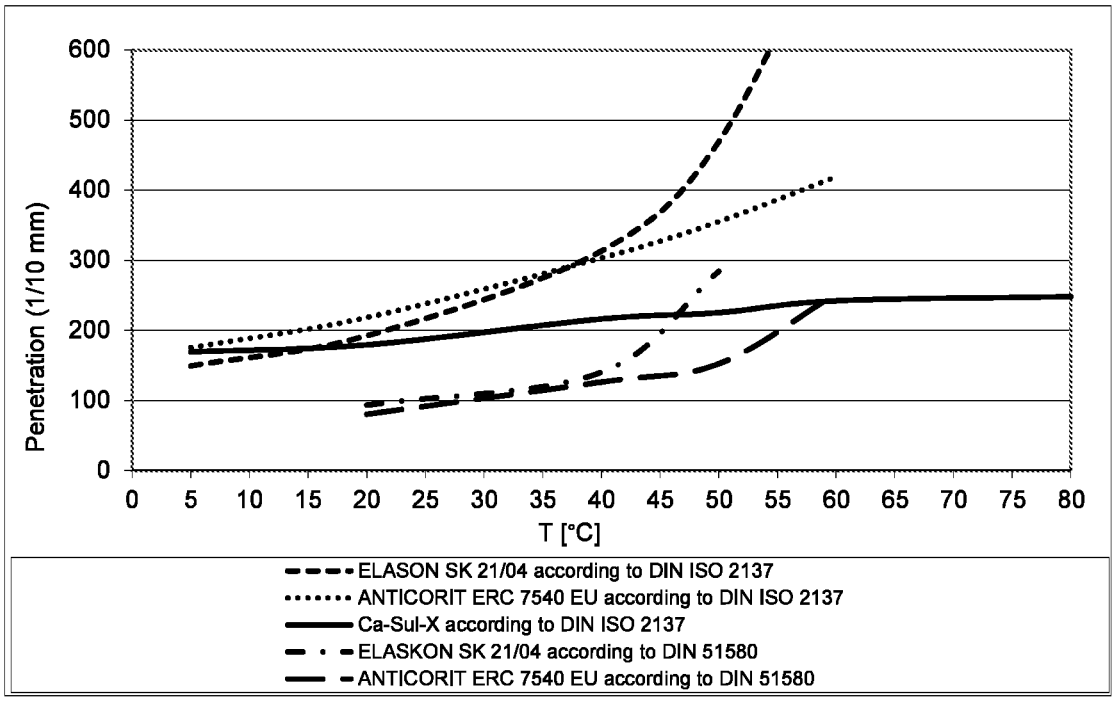
FIG. 3: Determination of the shear stability temperature dependency by measuring the cone penetration according to DIN 51580 and DIN ISO 2137

B.2 Determination of the Cone Penetration According to DIN 51580 or DIN ISO 2137 Respectively The bubble-free and clear, melted sample was poured into a test cylinder and cooled under the conditions prescribed. Using a penetrometer, the penetration depth of a test cone (total mass 150 g) which is under a load and equilibrated is determined during a testing time of 5 seconds at constant temperature. Here, along with hybrid Ca—X, hybrid Ca-Sul-X and in particular Ca-Sul-X also exhibited better consistency and temperature behavior compared to an oil/wax-based rope lubricant (Elaskon 21/04), as seen in FIG. 2. Here it is also desirable that the cone penetration values increase as little as possible with the temperature, but at least that an increase occurs only at higher temperatures. FIG. 3 makes it apparent that there is significantly better shear stability compared to an oil/wax-based rope lubricant. The measurement of shear stability temperature dependency was performed in accordance with DIN 51580 (FIG. 3) and according to DIN ISO 2137 (FIGS. 2 and 3).

B.3 Determination of the Breaking Point According to Fraass (DIN EN 12593)

A bitumen layer applied to a flat blank was cooled here at 1° C. per minute and subjected to defined flexure after 1 minute in each case. The breaking point according to Fraass is the temperature in degrees centigrade at which the bitumen layer breaks or cracks during flexure under the defined test conditions.

The significantly better low temperature behavior compared to oil/wax-based rope lubricants is apparent in the following table.

| | Breaking Point [° C.] |
|---|---|
| Ca-Sul-X | −62 |
| ANTICORIT ERC 7540 EU | −40 |
| ELASKON SK 21/04 | −38 |
| ELASKON 20BB | −36 |
| NYROSTEN T55 | −20 |

B.4 Salt Spray Fog Testing According to DIN EN ISO 9227

A cold rolled steel test object with the dimensions 15×10 cm was immersed in a solution of 30% rope lubricant and solvent and stored hanging on a nonmetallic material (such as synthetic fibers, cotton fibers or other insulating material) to evaporate the solution. The holders for the samples were also made of resistant nonmetallic material. Four samples were placed in four quadrants at an angle of) 20° (±5° vertically in the chamber. The testing temperature was 35° C., the spray volume 1.5 (±0.5) ml/h and the concentration of the spray solution 50 (±5) g/l NaCl.

The corrosion protection behavior exhibited was comparable to that of common oil and wax-based rope lubricant formulations.

| | t [h] | | | | | | | | |
|---|---|---|---|---|---|---|---|---|---|
| | 30 | 50 | 125 | 150 | 220 | 290 | 310 | 370 | 460 |
| | Corrosion [%] | | | | | | | | |
| Ca-Sul-X | 0 | 0 | 0 | 0 | 5 | 5 | 5 | 40 | 70 |
| Ca-Sul-X hybrid | 0 | 0 | 0 | 0 | 10 | 30 | 60 | 75 | 90 |
| Hybrid Ca-X | 0 | 0 | 5 | 10 | 60 | 75 | 90 | 90 | 95 |
| ANTICORIT ERC 7540 EU | 0 | 0 | 5 | 10 | 15 | 30 | 40 | 50 | 60 |
| Elaskon 20 BB 94 | 15 | 50 | 100 | 100 | 100 | 100 | 100 | 100 | 100 |

| | t [h] | | | | |
|---|---|---|---|---|---|
| | 490 | 550 | 620 | 650 | 770 |
| | Corrosion [%] | | | | |
| Ca-Sul-X | 80 | 95 | 100 | 100 | 100 |
| Ca-Sul-X hybrid | 90 | 100 | 100 | 100 | 100 |
| Hybrid Ca-X | 95 | 100 | 100 | 100 | 100 |
| ANTICORIT ERC 7540 EU | 70 | 90 | 100 | 100 | 100 |
| Elaskon 20 BB 94 | 100 | 100 | 100 | 100 | 100 |

In contrast to ANTICORIT ERC 7540 EU and the hybrid Ca—X, the Ca-Sul-X and hybrid Ca-Sul-X contained no additional corrosion protection additives.

B.5 Testing of Lubricating Greases for Corrosion Prevention Properties—SKF-Emcor Method (DIN 51802)

The lubricating grease was tested in self-aligning ball bearings with the addition of water. The tracks of the outer rings for the test bearings were checked for corrosion after a prespecified cycle with defined run duration at a rotational speed of 80 $min^{-1}$ without heating and load and with a defined idle duration.

The corrosion protection observed was comparable and in some cases better compared to typical oil/wax-based rope lubricants formulations.

| | Distilled Water | 3% NaCl Solution |
|---|---|---|
| Ca-Sul-X | — | 0-1 |
| Hybrid Ca-X | 1 | (1)-2 |
| ANTICORIT ERC 7540 EU | (0)-1 | 4 |
| RENOLIT LC-WP 2 | 0 | 5 |
| RENOLIT CA-FG 50 | 3 | — |
| Elaskon 20 BB 94 | 1 | 2-3 |

| Corrosion Level | Meaning | Description |
|---|---|---|
| 0 | No corrosion | Unchanged |
| 1 | Traces of corrosion | No more than 3 corrosion spots, of which none has a diameter above 1 mm |
| 2 | Slight corrosion | No more than 1% of the surface corroded, but more or larger spots of corrosion than for Corrosion Level 1 |
| 3 | Moderate corrosion | More than 1%, but not more than 5% of the surface corroded |
| 4 | Heavy corrosion | More than 5%, but not more than 10% of the surface corroded |
| 5 | Very heavy corrosion | More than 10% of the surface corroded |

B.6 Tribological Testing in the Translative Oscillation Testing Device (DIN 51834)

The test objects installed in a test chamber of the oscillation testing device and wetted with lubricant were put under mechanical load with a prespecified normal force with a prespecified testing frequency and a prespecified oscillatory travel. The friction forces were measured continuously.

Figure 4:
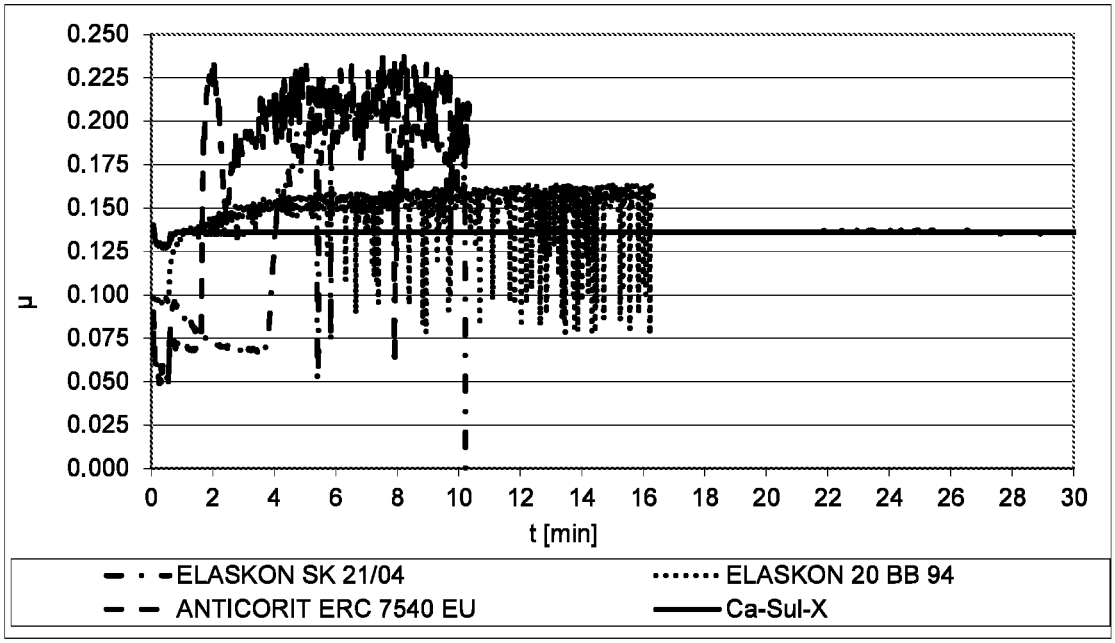
FIG. 4: Tribological testing in a translative oscillation testing device: Load bearing behavior at higher compressions.

Significantly better load bearing behavior was observed at higher compressions for the product Ca-Sul-X compared to Elaskon SK21/04, Elaskon 20 BB 94 and Anticorrit ERC 7540 EU, cf. FIG. 4.

B.7 Testing of Lubricants—Testing in the Four-Ball Tester

Determination of the welding load of consistent lubricants according to DIN 51350/4

The consistent lubricant was tested in a four-ball system comprised of a rotating ball which glides on three balls of the same type under selectable test forces. The testing force was increased in steps until a welding of the four-ball system occurred.

| | Weld Load according to DIN 51350/4 [N] |
|---|---|
| Ca-Sul-X | 6500 |
| ANTICORIT ERC 7540 EU | 1800 |
| Elaskon SK-U | 1800 |
| Elaskon SK-CE | 2600 |

Significantly higher load bearing behavior resulted for Ca-Sul-X.

B.8 Testing of Lubricants—Testing in the Four-Ball Tester (Determination of Wear Values for Consistent Lubricants According to DIN 51350/5)

To determine the wear protection properties, endurance testing was conducted with a defined load and then the calotte diameter of the three stationary balls was measured and averaged.

| | Characteristic wear value according to DIN 51350/5 1 h/300N [mm] |
|---|---|
| Ca-Sul-X | 0.33 |
| Hybrid Ca-X | 0.28 |
| ANTICORIT ERC 7540 EU | 0.82 |
| Elaskon 20 BB 94 | 0.52 |

Good wear protection behavior was observed for Ca-Sul-X and hybrid Ca—X compared to conventional commercially available rope lubricant compositions.

B.9 Plate/Plate Adhesion Test (in-House Test Method)

Figure 5:
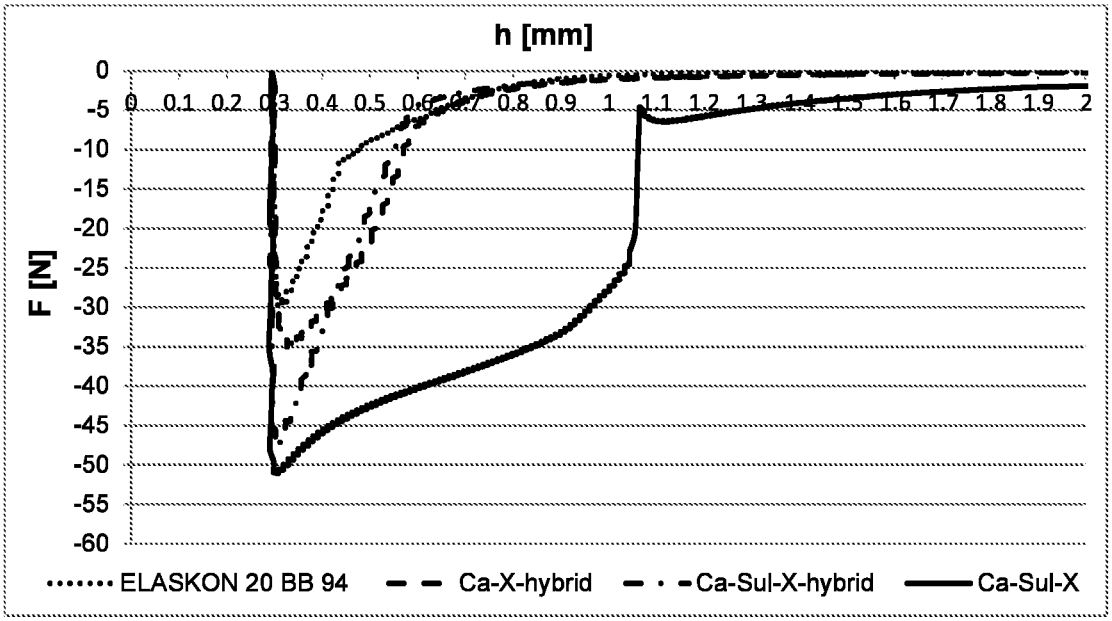
FIG. 5: Plate/plate adhesion measurement.

The rope lubricant sample was applied using a template in a plate/plate rheometer and heated to 80° C. After reaching the temperature, the excess quantity of sample was removed using a spatula. After cooling to 40° C., the template was removed and the upper plate was moved down again onto the solidified lubricant sample until a predefined gap was reached. Then a preset program was used to move the upper plate down slowly into the lubricant sample before moving it back out again out of the sample abruptly after reaching a predetermined distance of the lower to the upper plate. The force needed to pull the upper plate back out of the lubricant composition was measured. Here it was seen that a lubricant composition based on hybrid CA-X and Ca-Sul-X had significantly better adhesion than conventional oil/wax-based lubricants (cf. FIG. 5). Adhesion is of particular importance for rope lubricants, because the grease is to be "held" in the rope.

B.10 Fatigue Test on the Rope (Otto Test)

A loop of rope provided with the grease to be tested is guided over a roller system and moved over the rollers with a pendulum motion. A total of 1.2 million rollovers were performed using the same load in each case. The rope is evaluated according to the number of wire breaks measured, the formation of rust and the white paper test. The white paper test refers to the paper found under the test apparatus and refers to the quantity or number of particles falling onto the paper. The evaluation scale for the white paper test and formation of corrosion is as follows: 0 none, 1 hardly any, 2 little, 3 a lot, and 4 extreme degree of particles or corrosion.

| Lubricant | Wire Breaks | Corrosion Spots | White Paper Test |
|---|---|---|---|
| Ca-Sul-X | 0 | 0 | 0 |
| ANTICORIT ERC 7540 EU | 1 | 1 | 0 |
| Berucoat AK 376 | 113 | 3 | 3 |
| Macromelt | 145 | 4 | 4 |
| Bio Grease MP 2 | 0 | 1 | 1 |
| OKS 450 | 0 | 2 | 0 |

The invention claimed is:

1. A method of use of a lubricating grease composition as a lubricant for wire ropes, the method comprising:

applying the lubricant grease composition to a wire rope, the lubricating grease composition comprising:

(i) a calcium sulfonate complex hybrid lubricating grease composition comprising a base oil, at least one overbased calcium salt of an organic sulfonic acid, at least one complexing agent and calcium carbonate having a calcitic structure, or (ii) a calcium complex hybrid lubricating grease composition comprising a base oil, at least one calcium soap of at least one fatty acid including a hydroxy fatty acid and at least one complexing agent, or (iii) a mixture of (i) and (ii), wherein the lubricating grease composition according to (i), (ii) and (iii) comprises in each case 10 to 50 weight percent wax and the wax is a hydrocarbon wax and has a congealing point above 70° C., wherein as the at least one complexing agent at least acetic acid, dicarboxylic acids or phosphoric acid are used.

2. The method of use according to claim 1, wherein the lubricating grease composition comprises 20 to 35 weight percent of the wax with a congealing point above 70° C.

3. The method of use according to claim 1, further comprising introducing the lubricating grease composition into the wire rope during manufacture of the wire rope, before multiple strands and/or wires are twisted to form the wire rope.

4. The method of use according to claim 1, wherein the calcium sulfonate complex hybrid lubricating grease composition (i) comprises:

(a) 5 to 80 weight percent base oil;

(b) 10 to 80 weight percent calcium sulfonate, with the calcium carbonate present therein at least partially in calcitic form;

(c) sulfonic acid; and (d) 10 to 50 weight percent wax, and wherein the lubricating grease composition is overbased.

5. The method of use according to claim 4, wherein the calcium sulfonate complex hybrid lubricating grease composition (i) comprises one or more of the following activators or these were added to the calcium sulfonate complex hybrid lubricating grease composition (i) during its production:

i) 1 to 20 weight percent water with C1 to C4 alcohols;

ii) 1 to 20 weight percent C1 to C4 alcohols, alkoxy alkanols and/or polyalcohols;

iii) 1 to 20 weight percent water with hydroxycarboxylic acids;

iv) 1 to 20 weight percent mixtures comprised of i) and ii) or ii) and iii) or i), ii) and iii);

and the activators are present in the lubricating grease composition during production and are driven out by heat treatment.

6. The method of use according to claim 4, wherein the calcium salt of an organic sulfonic acid is used as an overbased calcium salt of an organic sulfonic acid comprising $Ca(OH)_2$ and $CaCO_3$.

7. The method of use according to claim 1, wherein the calcium sulfonate complex hybrid lubricating grease composition (ii) comprises:

(a) 40 to 90 weight percent base oil;

(b) at least one calcium soap of a fatty acid including a hydroxy fatty acid;

(c) at least one complexing agent; and (d) 10 to 50 weight percent of the wax.

8. The method of use according to claim 1, wherein the lubricating grease composition further comprises additional thickeners.

9. The method of use according to claim 1, wherein the lubricating grease composition has a cone penetration value of 200 to 260 0.1 mm (at 25° C.).

10. The method of use according to claim 1, wherein the calcium complex hybrid lubricating grease composition (ii) and/or the calcium sulfonate complex hybrid lubricating grease composition (i) is put into the core of the rope and the calcium complex hybrid lubricating grease composition (ii) and the calcium sulfonate complex hybrid lubricating grease composition (i) in each case have a cone penetration value of 400 to 475 0.1 mm (at 25° C.).

11. A method of applying:

(i) a calcium sulfonate complex hybrid lubricating grease composition comprising a base oil, at least one overbased calcium salt of an organic sulfonic acid, at least one complexing agent and calcium carbonate in a calcitic structure, or (ii) a calcium complex hybrid lubricating grease composition comprising a base oil, at least one calcium soap of at least one fatty acid including a hydroxy fatty acid and at least one complexing agent, or (iii) a mixture of (i) and (ii), wherein the lubricating grease composition according to (i), (ii) and (iii) comprises in each case 10 to 50 weight percent wax, and the wax has a congealing point above 70° C., wherein as a complexing agent at least acetic acid, dicarboxylic acids or phosphoric acid are used, as a lubricant for wire ropes by application to the wires by means of spraying, spreading, injecting, dip coating, flow coating, roller application or powder coating.

12. The method according to claim 11, wherein spraying takes place as an aerosol, airless or by electrostatic means.

13. The method according to claim 11, in which the wire rope comprises multiple wires or strands and, prior to joining the wires and/or strands, the lubricating grease composition is applied to the elements of the wire rope.

14. A wire rope provided with:

(i) a calcium sulfonate complex hybrid lubricating grease composition comprising a base oil, at least one overbased calcium salt of an organic sulfonic acid, at least one complexing agent and calcium carbonate in a calcitic structure, or (ii) a calcium complex hybrid lubricating grease composition comprising a base oil, at least one calcium soap of at least one fatty acid including a hydroxy fatty acid and at least one complexing agent, or (iii) a mixture of (i) and (ii), wherein the lubricating grease composition according to (i), (ii) and (iii) comprises in each case 10 to 50 weight percent wax, and the wax is a hydrocarbon wax and has a congealing point above 70° C., wherein as the at least one complexing agent at least acetic acid, dicarboxylic acids or phosphoric acid are used.

15. The wire rope according to claim 14, wherein the lubricating grease composition according to (i), (ii) and (iii) each comprise 20 to 35 weight percent of the wax with a congealing point above 70° C.

16. The wire rope according to claim 14, wherein the calcium sulfonate complex hybrid lubricating grease composition (i) comprises:

(a) 5 to 80 weight percent base oil;

(b) 10 to 80 weight percent calcium sulfonate, with the calcium carbonate present therein at least partially in calcitic form;

(c) a further sulfonic acid; and (d) 10 to 50 weight percent of the wax, and the lubricating grease composition is overbased.

17. The wire rope according to claim 14, wherein the calcium salt of an organic sulfonic acid is used as an overbased calcium salt of an organic sulfonic acid comprising $Ca(OH)_2$ and $CaCO_3$.

18. The wire rope according to claim 14, wherein the calcium sulfonate complex hybrid lubricating grease composition (ii) comprises:

(a) 40 to 90 weight percent base oil;

(b) at least one calcium soap of a fatty acid including a hydroxy fatty acid;

(c) at least one complexing agent; and (d) 10 to 50 weight percent of the wax.

19. The wire rope according to claim 14, wherein the lubricating grease composition further comprises one or more of the following components:

lubricating grease additives;

a further thickener selected from one or more of other metal soaps of C12 to C36 carboxylic acids as well as their hydroxycarboxylic acids;

conversion products of metal hydroxides with a phosphoric acid, acetic acid, boric acid or a dicarboxylic acid and/or salts thereof;

and/or polyurea thickener.

20. The wire rope according to claim 14, wherein the lubricating grease composition has a cone penetration value of 200 to 260 0.1 mm (at 25° C.).

21. The wire rope according to claim 14, wherein the calcium complex hybrid lubricating grease composition (ii) and/or the calcium sulfonate complex hybrid lubricating grease composition (i) is in put into the core of the rope and the calcium complex hybrid lubricating grease composition (ii) and the calcium sulfonate complex hybrid lubricating grease composition (i) in each case have a cone penetration value of 400 to 475 0.1 mm (at 25° C.).

22. The method of use according to claim 8, wherein the additional other thickeners are selected from one or more of:

metal soaps of C12 to C36 carboxylic acids as well as their hydroxycarboxylic acids;

conversion products of metal hydroxides with a phosphoric acid, acetic acid, boric acid or a dicarboxylic acid including the salts thereof; and polyurea thickeners.

23. The method of use according to claim 1, wherein the hydrocarbon wax is a paraffin wax, an isoparaffin wax, a polyolefin wax, a FT wax, a GTL wax or ozocerite.

24. The wire rope according to claim 14, wherein the hydrocarbon wax is a paraffin wax, an isoparaffin wax, a polyolefin wax, a FT wax, a GTL wax or ozocerite.

* * * * *